US006481254B1

(12) United States Patent
Zheng et al.

(10) Patent No.: US 6,481,254 B1
(45) Date of Patent: Nov. 19, 2002

(54) CYLINDER LOCK COMBINED WITH A MAGNETIC PIN AND A NON-MAGNETIC PIN

(75) Inventors: Yong Zheng, Beijing (CN); Jianxin Wang, Beijing (CN)

(73) Assignee: Beijing Jinweilide Lock Trade Co., Ltd., Beijing (CN)

( * ) Notice: Subject to any disclaimer, the term of this patent is extended or adjusted under 35 U.S.C. 154(b) by 0 days.

(21) Appl. No.: 09/701,000

(22) PCT Filed: Mar. 22, 2000

(86) PCT No.: PCT/CN00/00057

§ 371 (c)(1),
(2), (4) Date: Jan. 11, 2001

(87) PCT Pub. No.: WO00/57008

PCT Pub. Date: Sep. 28, 2000

(30) Foreign Application Priority Data

Mar. 24, 1999 (CN) ..... 99205381 U

(51) Int. Cl.[7] ..... E05B 47/00
(52) U.S. Cl. ..... 70/276; 70/413
(58) Field of Search ..... 70/276, 413

(56) References Cited

U.S. PATENT DOCUMENTS 3,566,637 A * 8/1966 Hallmann ..... 70/276
3,518,855 A * 3/1967 Wake ..... 70/276
3,512,382 A * 4/1968 Check et al. ..... 70/276
4,026,134 A * 12/1975 Woolfson ..... 70/276
4,333,327 A * 2/1980 Wake ..... 70/276
4,398,404 A * 12/1980 Wake ..... 70/276
4,627,251 A * 9/1984 Bhate ..... 70/276

FOREIGN PATENT DOCUMENTS

CN 2082291 Y 8/1991
CN 2184746 Y 12/1994
CN 2185774 Y 12/1994
CN 2352613 X 12/1999

* cited by examiner

*Primary Examiner*—J. J. Swann
*Assistant Examiner*—William S Fee
(74) *Attorney, Agent, or Firm*—Alston & Bird LLP

(57) ABSTRACT

A lock device controlled by both mechanical force and magnetic force, comprising a cylinder having at least a group of mechanical pins and a group of magnetic pins; said group of magnetic pins including a slidable magnetic pin in the pin bore of the plug and a slidable metal pin in the pin bore of the shell; a key that matches with said lock device, when said key is inserted into the plug, a plurality of recesses of key match with the mechanical pins which are disposed in the pin bores of the plug; and a plurality of magnetic balls in the key match with the magnetic pins which are disposed in the pin bores of the plug; when the key is not inserted in plug, the metal pins partially extend into the pin bores of plug and bridge the shear plane between the plug and the shell by the action of a coil spring that locates in the pin bore of the shell; and polarities of the poles of the magnetic balls in the key and the opposite magnetic pins on their neighborhood faces are identical.

5 Claims, 2 Drawing Sheets

CYLINDER LOCK COMBINED WITH A MAGNETIC PIN AND A NON-MAGNETIC PIN

FIELD OF THE INVENTION

This invention relates to a cylinder lock with combination of pins, and more particularly, to a lock device which includes a cylinder having a plurality of combination of mechanical pins and magnetic pins.

BACKGROUND OF THE INVENTION

Most of conventional lock devices utilizing mechanical pins are well known in the art. The cylinder of these lock devices include a cylindrical plug that is rotatably mounted in a outer shell, and provide two groups of pin bores separately in the plug and in the shell which align with each other. Pins are installed slidingly in these pin bores. If a key is not inserted, a pin will bridge the shear plane between the plug and the shell in each bore, as the pin partly extend in the bore of the plug and at the same time it partially extends in the bore of the shell, so as to maintain the lock in the locked condition. Oppositely, if a key is inserted, the raised portions of the key will drive the pins which bridge the shear plane between the plug and the shell into the pin bores of the shell, with the result that the plug can be rotated relatively with the shell.

In the process of producing conventional cylinder lock, the inner diameter of the pin bore is formed several hundred micrometers bigger than the outer diameter of the pin, so that the plug can be rotated a certain angle relatively with the shell, for making the pin move along the pin bore smoothly, even if the key is not inserted; and the pins of the cylinder can directly touch the raised portions of the key inserted from the key aperture. Therefore, such a conventional lock can be unlocked rather easily by the use of a so-called "master-key". One of the typical master key is a metal piece with a little hook at one end of it. When the master key is inserted into the key aperture, turning on the plug forcibly, there will be a relative dislocation between the pins in the plug and the pins in the shell. Then by the hook, pushing each of all pins that bridge the shear plane of lock into the pin bores of the shell one by one. When the pins that have been pushed into pin bores of the shell is pushed back by the action of the coil spring, the pins can not return back into the pin bores of the plug any more because the dislocation between the pins in the plug and the pins in the shell cause the two groups of pin bores disalignment with each other. So that once all of the pins bridging the shear plane of lock are pushed into the pin bores of the shell, this conventional cylinder lock is unlocked.

Chinese Utility Model Publication 2082291 discloses one such cylinder lock including a plurality of magnetic pins that bridge the shear plane between the plug and the shell in each bore, and disposing a plurality of stationary magnets separated in the axial center lines of the magnetic pins. A plurality of magnets are arranged along the length of the key correspondingly the magnetic pins. When the key is inserted into the key aperture, the raised portions of the key and the magnets simultaneously control the mechanical pins and the magnets of the key so as to make the plug and shell rotation with each other in order to unlock the lock. It is an effective method to avoid unlocking the lock with the "master key". Thus, a highly secure lock is provided. But the magnetic pins of this lock are usually located far away from the key aperture due to the attraction of the stationary magnets. For making the key compact for portability, it is usually impossible to make the magnets of the key too big, thus the magnetic attraction of them is quite limited, which frequently results in the unlocking ineffective. On the other hand, by the attraction of the stationary magnets, the magnetic pins bridge the shear plane between the plug and the shell. When suffering an extra intensity vibration, there is much probability that the magnetic pins fall, thus causing the lock to be unlocked. The structure of this lock device is distinct from the structure of conventional cylinder lock; however, it is rather expensive to manufacture.

SUMMARY OF THE INVENTION

Accordingly, it is an object of the present invention to provide an improved cylinder lock device that is simple in construction, reliable in unlocking, inexpensive in manufacture, so as to overcome the drawbacks in the art as mentioned above. A further object of the present invention is to provide an improved cylinder lock device that has an advantage of resistance to being disturbed from circumstance.

For realizing the above objects, the present invention provides a lock device comprising a cylinder having at least a group of mechanical pins and a group of magnetic pins; wherein, the group of magnetic pins includes a slidable magnetic pin in the pin bore of the plug and a slidable metal pin in the pin bore of the shell and a coil spring, when the key is not inserted in plug, the metal pin partially extends into the pin bore of plug and bridges the shear plane between the plug and the shell by the action of said coil spring that locates in the pin bore of the shell.

The present invention also provides a key that can be used with the above lock device. When said key is inserted into the plug, a plurality of recesses of key match with the mechanical pins which are disposed in the pin bores of the plug; and a plurality of magnetic balls in the key match with the magnetic pins which are disposed in the pin bores of the plug; and the polarities of the magnetic balls in the key and the opposite magnetic pins on their neighborhood surfaces are identical.

Said bore of plug is a cylindrical blind bore with opening toward the shell. When said key is not inserted, said magnetic pins maintain at the closed ends of the blind bores; and the metal pins are pushed to the magnetic pins and the metal pin normally extends into the pin bore of plug and bridges the shear plane between the plug and the shell by the action of a coil spring.

Within the groups of magnetic pins according to the present invention, the outer diameter of the magnetic pin is formed bigger than the inner diameter of the pin bore of the shell so as to ensure the magnetic pin can not enter the pin bore of the shell.

In order to ensure unique mate between the key and the lock, the polarity of the magnetic pins, which face to the key apertures, is either N or S pole in the each magnetic pins group, and different locks have different combination of polarity orientations of magnetic pin groups.

Within the plug of the cylinder lock according to the present invention, several groups of magnetic pins are disposed along one lengthwise side of the key aperture, and several groups of mechanical pins are disposed along another lengthwise side of the key aperture. It is preferable that said magnetic and mechanical pin groups longitudinally line in a row.

The cylinder lock device with above structure can avoid unlocking by the "master key", because the magnetic pin bores do not communicate with the key aperture. Normally, the magnetic pins locate in a position that is near the key aperture. Therefore, when the key is inserted, the magnetic force is greatest, which produced by the polarity of poles between the magnetic ball in the key and the magnetic pin in the plug, so as to ensure unlocking reliable. Because the compressing of the spring is hardly affected by the outside, the lock device is seldom unlocked due to the outside vibration and the likes. The structure of the cylinder lock device in the present invention is basically the same as that of the conventional cylinder lock. After a little modification based on the product line and the technique of the art, the lock according to the invention can be manufactured immediately. As a result, the cost of manufacture decreases greatly.

The present invention will become apparent from the detailed description taken in conjunction with the preferred embodiments herein below and the accompanying drawings, and wherein:

PREFERRED EMBODIMENT OF THE INVENTION

Figure 2:
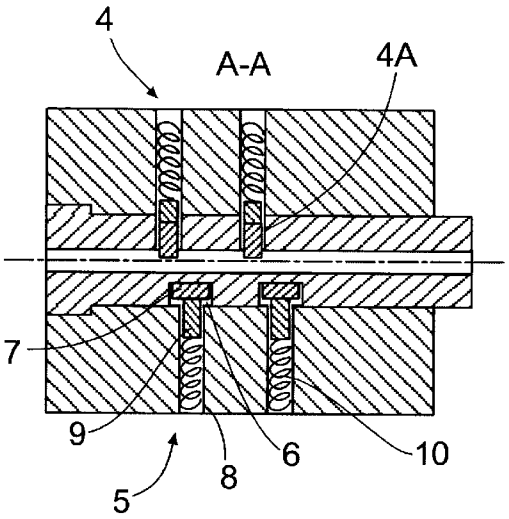
FIG. 2 is a cross-sectional view taken on the line A—A in FIG. 1.
Figure 1:
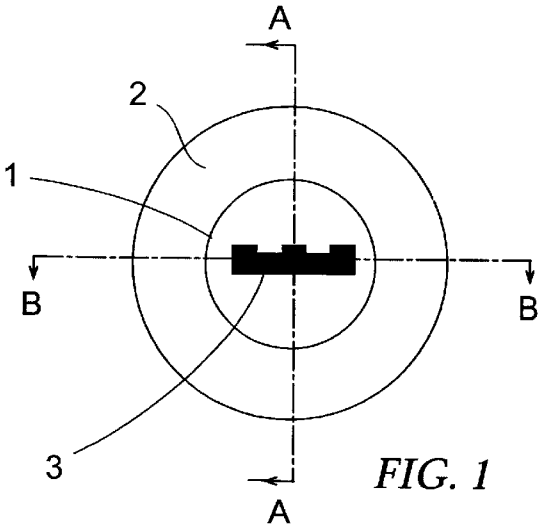
FIG. 1 is a longitudinal view of the cylindrical plug without the key inserted in the plug.
Figure 3:
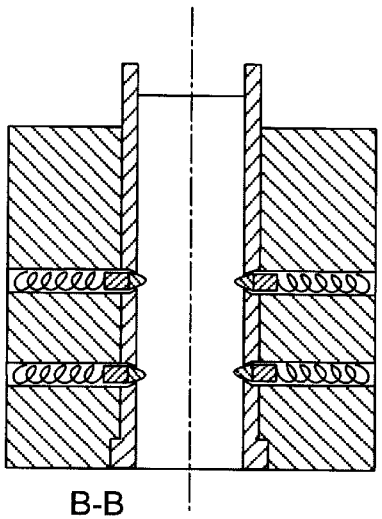
FIG. 3 is a cross-sectional view taken on the line B—B in FIG. 1.

As illustrated in detail in FIG. 1, the present invention provides a lock cylinder that is comprised of a plug 1 and a shell 2, and disposes a longitudinal key aperture 3 in the center of the plug 1. As illustrated in FIG. 2 and FIG. 3, there are several groups 4 of mechanical pins and several groups 5 of magnetic pins, which are disposed in the position between the plug 1 and the shell 2. The group 5 of the magnetic pins includes a slidable magnetic pin 7 in the pin bore 6 of the plug 1, said bore 6 is a cylindrical blind bore with opening toward the shell 2; a slidable metal pin 9 in the pin bore 8 of the shell; and a coil spring, when a key is not inserted into the key aperture 3 of the plug 1, the metal pin 9 partially extents into the pin bore 6 of the plug 1 and bridges the shear plane between the plug 1 and the shell 2 by the action of said coil spring 10 that locates in the pin bore of the shell.

The present invention also provides a key 11 that can be used with the above lock device. When said key 11 is inserted into the key aperture 3 which is disposed in center of the plug 1, a plurality of recesses 12 of the key match with the mechanical pins 4 which are disposed in the pin bores 4A of the plug 1; and a plurality of magnetic balls 13 in the key 11 match with the magnetic pins 7 which are disposed in the pin bores 6 of the plug 1; and the polarities of the magnetic balls 13 in the key 11 and the opposite magnetic pins 7 on their neighborhood surfaces are identical.

Within the groups 5 of magnetic pins according to the present invention, the outer diameter of the magnetic pin 7 is bigger than the inner diameter of the pin bore 8 of the shell to ensure that the magnetic pin can not enter the pin bore of the shell.

In order to ensure unique mate between the key 11 and the lock, the polarity of the magnetic pins 7 facing to the key apertures, is either N or S pole in each magnetic pin group 5, and different locks have different combination of polarity orientations of magnetic pin groups.

The structure and working way of the mechanical pin groups 4 of the cylinder lock according to the present invention are the same as those of the conventional cylinder lock.

Figure 5:
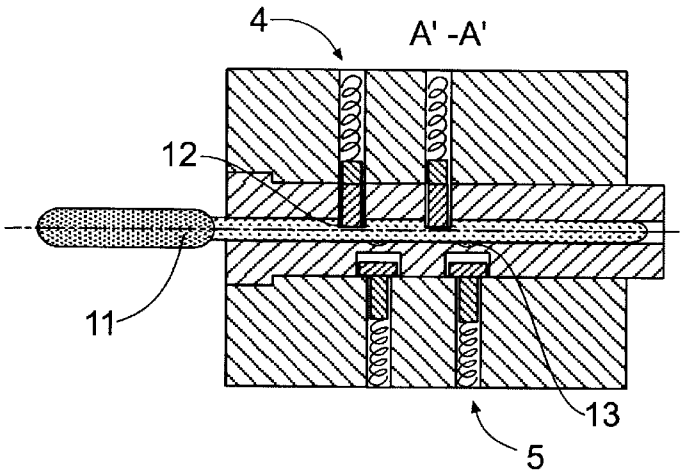
FIG. 5 is a cross-sectional view taken on the line A'—A' in FIG. 4.
Figure 4:
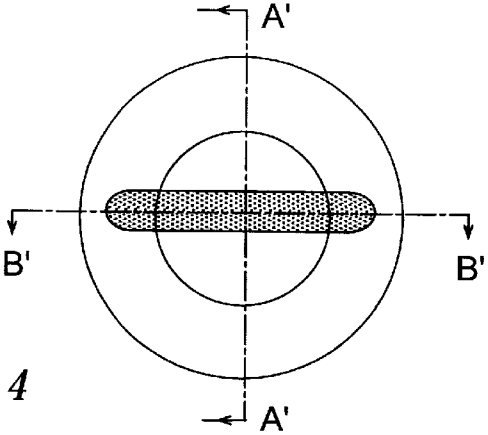
FIG. 4 is a longitudinal view of the cylindrical plug with the key inserted in the plug.
Figure 6:
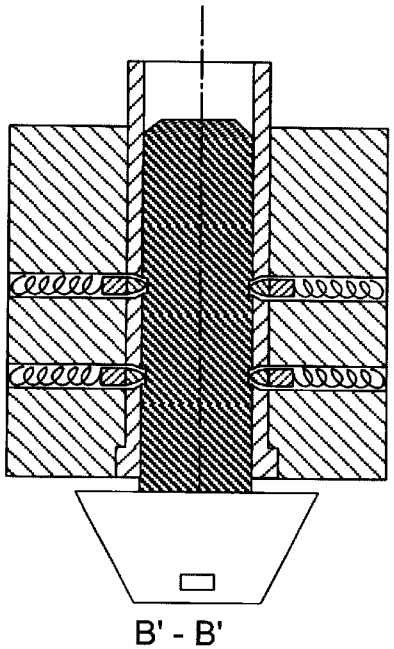
FIG. 6 is a cross-sectional view taken on the line B'—B' in FIG. 4.

The cylinder lock devices with the above structure is illustrated in FIG. 1, FIG. 2 and FIG. 3, within the magnetic pin groups 5, a magnetic pin 7 is arranged in the pin bore 6 of the plug. A coil spring 10 is disposed in the pin bore 8 of the shell, and one end of the spring far away from the plug is fixed on the shell 2. A metal pin 9 longitudinal moveable in the pin bore 6 of the plug and the pin bore 8 of the shell is disposed in a position between the magnetic pin 7 and the coil spring 10. When the key 11 is not inserted by the action of the coil spring 10, the metal pin 9 is pushed to the magnetic pin 7, and the magnetic pin 7 simultaneously touch the bottom of the pin bore 6 of the plug. At the same time, the metal pin 9 bridges the shear plane between the plug 1 and the shell 2. As illustrated in FIG. 4. FIG. 5 and FIG. 6, when the key 11 is inserted into the key aperture 3, the polarity of the magnetic ball 13 facing to the magnetic pin group 5 and corresponding to the magnetic pin group 5 is the same as that of the magnetic pin 7 facing to the key aperture 3. Therefore at the same time, the magnetic pin 7 is pushed far away from the key aperture 3 under the action force with the magnetic pin 7. As the magnetic pin 7 is pushed to move a certain distance, the repulsion produced between the magnetic pin 7 and the magnetic ball 13 decreases so as to balance out the pushing force of the coil spring 10, and at that time, the magnetic pin 7 stays in the pin bore 6 of the plug, while the metal pin 9 completely stays in the pin bore 8 of the shell, thus causing the metal pin 9 to move away from the locking position which is in the shear plane to the unlocking position.

Within a preferred embodiment of the present invention, the outer diameter of the magnetic pin 7 is bigger than the inner diameter of the pin bore 8 of the shell. Thus causing the magnetic pin 7 to touch the shell 2 and then to stop moving, and only the metal pin 9 stays in the pin bore 8 of the shell, which can avoid the magnetic pin 7 entering the pin bore 8 of the shell due to the unstableness of the pushing force of the spring 10 and that the plug 1 and the shell 2 are both locked by the magnetic pin 7.

Within the plug of the cylinder lock according to the present invention, several groups 5 of magnetic pins are disposed along one lengthwise side of the key aperture 3, and several groups 4 of mechanical pins are disposed along another lengthwise side of the key aperture 3. Several groups 4 of mechanical pins are disposed along both narrow sides of the key aperture 3. It is preferable that said magnetic and mechanical pin groups 4 line in a row along the longitudinal direction of the key aperture 3. The structure further improve unique mate between the key and the lock, therefore the cylinder lock according to the present invention is safer and more reliable than ever before.

The above preferred embodiment is only an example for setting forth the present invention clearly, and not for the purpose of limitation. All such modification as would be obvious to one skilled in the art are intended to be included in the scope of the present invention claims, herein it is unnecessary and impossible that take down all embodiments, and such variants are not to be regarded as a departure from the spirit and scope of the invention.

In the claims:

1. A cylindrical lock having combinations of pins, comprising:

a plug portion defining a plurality of radially-extending pin bores and axially-extending key channel;

a shell portion configuration to surround the plug portion and defining a plurality of radially-extending pin bores corresponding to the plug portion pin bores, with each shell portion pin bore having a diameter, the shell portion and the plug portion defining shear line therebetween;

a plurality of mechanical pins, each mechanical pin including a first pin portion slidably disposed within one of the plug portion pin bores and a second pin portion slidably disposed in the corresponding shell portion pin bore, the first and second pin portions being biased toward the key channel by a spring such that the second pin portion normally extends across the shear line and into the plug portion pin bore so as to lock the plug portion with respect to the shell portion;

a plurality of magnetic pins, each magnetic pin including a magnetic pin portion having a polarity and a diameter and being slidably disposed in one of the plug portion pin bores, a metallic pin portion slidably disposed in the corresponding shell portion pin bore, and a spring disposed within the corresponding shell portion pin bore so as to bias the metallic pin portion toward the plug portion pin bore, the metallic pin portion normally being biased by the spring to extend across the shear line and into the corresponding plug portion pin bore so as to lock the plug portion with respect to the shell portion; and a key configured to be received by the key channel, the key including a plurality of recesses corresponding to the mechanical pins when the key is received in the key channel, the recesses cooperating with the first pin portions so as to urge the second pin portions out of the respective plug portion pin bores and into the corresponding shell portion pin bores against the biasing of the springs, the key further including a plurality of magnetic balls corresponding to the magnetic pins when the key is received in the key channel, each magnetic ball having a polarity the same as the polarity of the corresponding magnetic pin portion, each magnetic ball thereby being configured to repel the corresponding magnetic pin portion when the key is received in the key channel such that each magnetic pin portion urges the corresponding metallic pin portion out of the plug portion pin bore and into the corresponding shell portion pin bore against the biasing of the spring, the diameter of the shell portion pin bore being less than the diameter of the magnetic pin portion so as to prevent the magnetic pin portion from crossing the shear line and entering the shell portion pin bore, the key thereby being configured to cooperate with the mechanical pins and the magnetic pins when the key is received in the key channel so as to unlock the plug portion with respect to the shell portion.

2. A lock according to claim 1 wherein each of the plug portion pin bores in which one of the magnetic pins is disposed is a cylindrical blind bore having an opening extending into the plug portion from the shear line toward the key channel, and wherein the magnetic pin portion is disposed within the plug portion pin bore and normally biased toward the key channel by the spring, via the metallic pin portion, such that the metallic pin portion extends across the shear line into both the blind bore and the corresponding shell portion pin bore.

3. A lock according to claim 1 wherein the polarity of the magnetic pin portion of each magnetic pin is selectively determinable such that the plurality of magnetic pins is capable of being configured as a plurality of combinations of polarities.

4. A lock according to claim 1 wherein the key channel comprises opposing major-dimension sides and opposing minor-dimension sides, and wherein the plurality of magnetic pins is disposed along one of the major-dimension sides while the plurality of mechanical pins is disposed along the other major dimension side and the opposing minor-dimension sides.

5. A lock according to claim 4 wherein the plurality of magnetic pins and the plurality of mechanical pins are axially arranged in a row along the respective sides of the key channel.

* * * * *